US008561300B2

(12) United States Patent
Rehbein et al.

(10) Patent No.: US 8,561,300 B2
(45) Date of Patent: Oct. 22, 2013

(54) COMBINATION SHAVING AND TRIMMING DEVICE

(75) Inventors: Stefan Rehbein, Bad Soden am Taunus (DE); Cirilo Javier Perez Lopez, Eschborn (DE); Nicolas Salomez, Eschborn (DE); Gerrit Roenneberg, Darmstadt (DE)

(73) Assignee: The Gillette Company, Boston, MA (US)

( * ) Notice: Subject to any disclaimer, the term of this patent is extended or adjusted under 35 U.S.C. 154(b) by 363 days.

(21) Appl. No.: 12/816,712

(22) Filed: Jun. 16, 2010

(65) Prior Publication Data

US 2011/0308087 A1 Dec. 22, 2011

(51) Int. Cl.
*B26B 21/40* (2006.01)
*B26B 19/38* (2006.01)

(52) U.S. Cl.
USPC ..... 30/34.1; 30/34.05; 30/50; 30/122

(58) Field of Classification Search
USPC ..... 30/34.05, 34.1, 50, 122, 123, 537
See application file for complete search history.

(56) References Cited

U.S. PATENT DOCUMENTS

| | | | | |
|---|---|---|---|---|
| 3,222,781 | A | | 12/1965 | Luther et al. |
| 3,552,007 | A | | 1/1971 | Yamada |
| 4,249,307 | A | | 2/1981 | Andis |
| 4,422,237 | A | * | 12/1983 | Trotta ..... 30/526 |
| 4,581,822 | A | | 4/1986 | Fujimura |
| 4,614,032 | A | | 9/1986 | Szabo |
| 4,631,825 | A | | 12/1986 | Kuriyama et al. |
| 4,694,575 | A | | 9/1987 | Boerger |
| 4,908,945 | A | * | 3/1990 | Jacobson ..... 30/41 |
| 4,914,816 | A | * | 4/1990 | Fenn et al. ..... 30/45 |
| 4,980,973 | A | | 1/1991 | Lee et al. |
| 5,046,249 | A | | 9/1991 | Kawara et al. |
| 5,299,354 | A | | 4/1994 | Metcalf et al. |
| 5,325,590 | A | | 7/1994 | Andis et al. |
| 5,386,631 | A | | 2/1995 | Van Asten et al. |
| 5,542,178 | A | | 8/1996 | Harkleroad |
| 5,761,813 | A | * | 6/1998 | Frick et al. ..... 30/41 |
| 5,956,851 | A | * | 9/1999 | Apprille et al. ..... 30/47 |
| 6,044,558 | A | | 4/2000 | Wu |
| 6,052,905 | A | | 4/2000 | Branchinelli et al. |
| D426,918 | S | | 6/2000 | Green |
| D431,095 | S | | 9/2000 | Hyman |
| 6,112,421 | A | * | 9/2000 | Greene ..... 30/526 |
| D432,265 | S | | 10/2000 | Kling et al. |
| D445,541 | S | | 7/2001 | Wursthorn |
| D446,351 | S | | 8/2001 | Greene |
| 6,378,210 | B1 | | 4/2002 | Bickford |
| D475,806 | S | | 6/2003 | Yang |
| 6,604,287 | B2 | | 8/2003 | Melton et al. |
| D481,169 | S | | 10/2003 | Cheung |
| D486,267 | S | | 2/2004 | Goetschi |
| 6,862,810 | B2 | | 3/2005 | Braun et al. |

(Continued)

FOREIGN PATENT DOCUMENTS

WO WO 94/04326 A1 3/1994

*Primary Examiner* — Hwei C Payer
(74) *Attorney, Agent, or Firm* — Jay A. Krebs

(57) ABSTRACT

A combination shaving and trimming device includes a handle having an upper end and lower end, a powered trimmer disposed adjacent the upper end, a wet-shaving razor attachment adapted for mounting over the trimmer onto the upper end of the handle. The combination shaving and trimming device includes alignment guides providing one way attachment of the wet-shaving razor attachment to the trimmer.

16 Claims, 16 Drawing Sheets

(56) References Cited

U.S. PATENT DOCUMENTS

| | | | | |
|---|---|---|---|---|
| D509,026 | S | 8/2005 | Leventhal et al. | |
| 6,928,738 | B2 | 8/2005 | Segrea | |
| D512,795 | S | 12/2005 | Carpenter | |
| D513,343 | S | 12/2005 | Bokelman-Dumas | |
| D514,256 | S | 1/2006 | Bokelman-Dumas | |
| 7,028,405 | B2 | 4/2006 | Paas et al. | |
| D521,683 | S | 5/2006 | Pepall | |
| 7,103,980 | B2 | 9/2006 | Leventhal | |
| D534,315 | S | 12/2006 | Provost et al. | |
| D534,686 | S | 1/2007 | Provost et al. | |
| D539,478 | S | 3/2007 | Leventhal et al. | |
| 7,197,827 | B2 * | 4/2007 | Paquette | 30/526 |
| D560,309 | S | 1/2008 | Garland et al. | |
| D563,045 | S | 2/2008 | Provost et al. | |
| D563,046 | S | 2/2008 | Provost et al. | |
| D568,534 | S | 5/2008 | Micinilio et al. | |
| D568,537 | S | 5/2008 | Micinilio et al. | |
| D568,539 | S | 5/2008 | Micinilio et al. | |
| D568,540 | S | 5/2008 | Micinilio et al. | |
| D568,541 | S | 5/2008 | Micinilio | |
| D571,954 | S | 6/2008 | Kling et al. | |
| D571,955 | S | 6/2008 | Wonderley et al. | |
| D577,864 | S | 9/2008 | Kitagawa et al. | |
| D591,451 | S | 4/2009 | Micinilio et al. | |
| D591,453 | S | 4/2009 | Micinilio et al. | |
| 7,536,787 | B2 | 5/2009 | Blaustein et al. | |
| D600,408 | S | 9/2009 | Micinilio et al. | |
| D604,014 | S | 11/2009 | Micinilio et al. | |
| D607,151 | S * | 12/2009 | Kling et al. | D28/48 |
| D624,702 | S | 9/2010 | Schulz | |
| D628,744 | S | 12/2010 | Goetschi | |
| 7,900,359 | B2 * | 3/2011 | Royle | 30/34.1 |
| D636,126 | S * | 4/2011 | Schulz et al. | D28/53 |
| D663,896 | S * | 7/2012 | Meech et al. | D28/49 |
| 8,209,868 | B2 * | 7/2012 | Schnak et al. | 30/45 |
| 2004/0158990 | A1 | 8/2004 | Heide | |
| 2004/0181954 | A1 | 9/2004 | Follo et al. | |
| 2005/0005453 | A1 | 1/2005 | Egeresi | |
| 2005/0246902 | A1 | 11/2005 | Poran | |
| 2007/0006463 | A1 | 1/2007 | Pennella | |
| 2007/0283567 | A1 | 12/2007 | Magli | |
| 2008/0000089 | A1 | 1/2008 | Pennella et al. | |
| 2008/0016691 | A1 | 1/2008 | Pennella et al. | |
| 2008/0034591 | A1 | 2/2008 | Fung | |
| 2008/0047145 | A1 | 2/2008 | Dietzel et al. | |
| 2008/0086887 | A1 | 4/2008 | Park et al. | |
| 2008/0110034 | A1 * | 5/2008 | Schnak et al. | 30/526 |
| 2009/0000124 | A1 | 1/2009 | Micinilio et al. | |
| 2009/0000125 | A1 | 1/2009 | Peyser et al. | |
| 2009/0165304 | A1 | 7/2009 | Blaustein et al. | |
| 2010/0011585 | A1 | 1/2010 | Maichel et al. | |
| 2010/0037463 | A1 | 2/2010 | Maichel et al. | |
| 2010/0064520 | A1 | 3/2010 | Park et al. | |
| 2010/0139097 | A1 | 6/2010 | Perez-Lopez et al. | |
| 2010/0299927 | A1 * | 12/2010 | Fischer et al. | 30/34.1 |
| 2011/0214289 | A1 * | 9/2011 | Maichel et al. | 30/29.5 |

* cited by examiner

COMBINATION SHAVING AND TRIMMING DEVICE

FIELD OF THE INVENTION

The invention relates to a combination shaving and trimming device. Particularly, the invention relates to a locking mechanism connecting a wet shaving razor attachment to a trimmer device. More particularly, the present invention relates to a wet shaving razor attachment including features for preventing incorrect fixation to the trimming device.

BACKGROUND OF THE INVENTION

Most consumers find that dealing with multiple tools like a razor, scissors and an electric trimmer every time you want to change the look of your facial hair can be a real hassle. Grooming devices providing both shaving and trimming are known in the art; however, such devices are often bulky and can be difficult to use. For instance, grooming devices having both electric trimming blades and wet shaving blades located on the same end of the device as disclosed in U.S. Pat. No. 7,536,787 can pose an obstructed view. For instance, the wet shaving blade may obstruct the user's view as he uses the trimmer to trim side burns, mustache, or other facial hair. Thus, there is a need for a shaving and trimming device having a removable shaving component such as a connecting member having one end attaching to a wet shaving razor blade cartridge and another end attaching to the trimmer.

The connecting member between trimmer and wet shaving razor blade cartridge has to fulfill several requirements. The structure has to be firm and secure during wet-shaving usage to transfer all forces and movements of the trimmer handle onto the wet shaving cartridge. Specifically, unintended disengaging of the attachment has to be avoided in order to prevent injuries. The structure has to be easily attachable and removable for the consumer to switch between wet-shaving and trimming applications. The structure has to be able to withstand an impact force in case the trimmer with wet-shaving attachment is dropped during use in order to prevent damage to the cartridge. In some combinations, the wet shaving and grooming device is designed such that the structure transfers vibrations generated from the trimmer handle into the wet shaving attachment. This requires a firm fit without any play or clearance between the parts that would result in loss of amplitude and possibly produce a rattling noise.

There is a need for a combination shaving and trimming device having a wet shaving attachment including a connecting member that is easily attachable and removable for the consumer. In addition there is a need for a wet shaving attachment including a connecting member providing an intuitive attachment that connects to the trimmer one way thereby reducing the chances for an unstable connection or damage to the connecting member and/or trimmer. Further, there is a need for a connecting member including a locking feature that not only secures the wet shaving attachment during use but is releasable so that the connecting member detaches from the trimmer under impact in case the device is dropped.

SUMMARY OF THE INVENTION

A combination shaving and trimming device is provided comprising a battery operated trimmer and wet-shaving razor attachment removably connected to the trimmer via a releasable locking mechanism. The trimmer comprises a handle having an upper end and lower end, a front side and a back side. A powered trimmer blade and trimmer housing are disposed adjacent the upper end. The trimmer housing includes alignment members disposed proximate the powered trimmer blade on opposite sides of the trimmer housing providing at least one first connection for the wet shaving razor attachment. The handle includes a slot on the back side of the handle between the upper end and lower end and more proximate to the upper end. The slot includes a forward side toward the upper end of the handle and an aft side toward the lower end of the handle. The forward side of the slot includes an overhanging lip which interfaces with the wet shaving razor attachment providing a second connection releasably attaching the handle to the wet-shaving razor attachment.

The wet-shaving razor attachment comprises a connecting member having a forward end and an aft end, a front face and a back face. The forward end of the connecting member includes alignment grooves disposed on opposite sides of the connecting member proximate the forward end. The alignment grooves releasably attach to the alignment members on the trimmer housing. The aft end of the connecting member includes at least one hook on the front face having a latching surface which releasably attaches to the overhanging lip on the forward side of the slot in the handle.

In one embodiment, a spring loaded slider is disposed on the back side of the handle proximate the upper end with the aforementioned slot disposed in the spring loaded slider. The spring loaded slider includes a spring that biases back and forth linear movement of the slider along the length of the handle and produces a biasing force between the overhanging lip on the forward side of the slot and the latching surface of the hook on the aft end of the connecting member.

In another embodiment a wet-shaving razor attachment for a trimming device is provided. The wet-shaving razor attachment attaches to the trimming device forming a combination shaving and trimming device. The wet-shaving razor attachment comprises a connecting member comprising alignment guides disposed on opposite sides of the connecting member proximate the forward end of the connecting member. The alignment guides releasably attach to alignment guides on opposite sides of the trimming device providing one way attachment of the connecting member to the trimming device. Preferably, the alignment guides disposed on opposite sides of the connecting member comprise alignment grooves and the alignment guides disposed on opposite sides of the trimming device comprise alignment pins. Alternatively, the alignment guides disposed on opposite sides of the connecting member can comprise alignment pins on the inside surface of the connecting member and the alignment guides disposed on opposite sides of the trimming device can comprise alignment grooves. At least one hook is disposed at the aft end of the connecting member. The hook releasably attaches to a slot in the combination shaving and trimming device. A razor cartridge is attached to the forward end of the connecting member.

DETAILED DESCRIPTION OF THE INVENTION

Figure 1C:
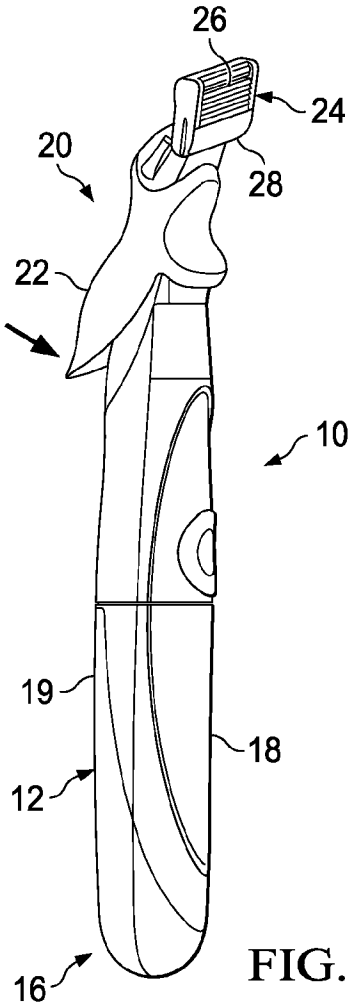
FIGS. 1*a*-1*c* are perspective views of the combination shaving and trimming device illustrating the installation of the wet shaving razor attachment.
Figure 1B:
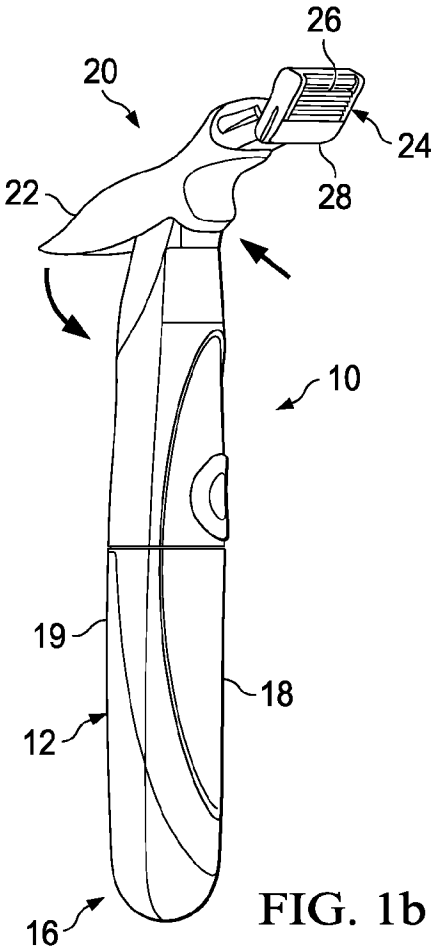
Figure 1A:
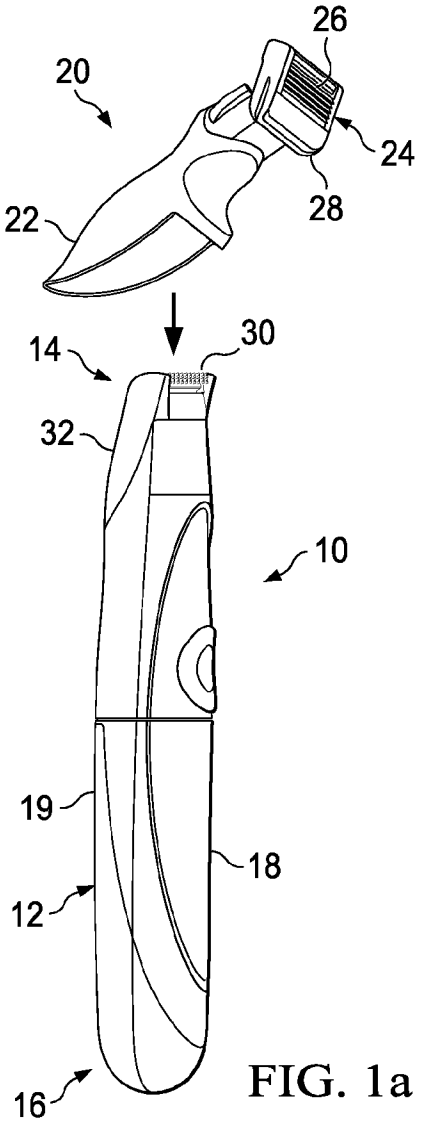

FIGS. 1*a*-1*c* show a combination shaving and trimming device 10. The device 10 includes a handle 12, a powered trimmer 30, and a wet-shaving razor attachment 20 removably connected to the trimmer 30. The handle 12 has an upper end 14 and lower end 16, a front side 18 and a back side 19. The trimmer 30 is located at or near upper end 14 on the front side 18 and is configured for moving at least one trimming blade, which may be serrated, and wherein this trimming blade is disposed within the trimmer 30. In certain embodiments, there may be more than one trimming blade disposed in a stacked position wherein at least one reciprocates against the other to effect a trimming or cutting action on hair that is placed adjacent to a cutting edge of the one or more trimming blades. A trimmer housing 32 is disposed adjacent the upper end 14 near the trimmer 30.

The wet-shaving razor attachment 20 includes connecting member 22 and razor cartridge 24. The connecting member 22 is adapted for mounting over the trimmer 30 onto the handle 12. The razor cartridge 24 engagably mates with the connecting member 22. In the embodiment of FIG. 1*a*-*c*, the razor cartridge 24 is removably attached to the connecting member 22. The razor cartridge 24 includes one or more blades 26 mounted within a housing 28 of the cartridge 24. The device 10 is configured to operate as a trimming device, as shown in FIG. 1*a*, with the wet shaving razor attachment 20 completely removed, or as a wet-shaving device with the wet shaving attachment 20 removably attached to upper end 14. FIGS. 1*b* and 1*c* illustrate the progression of the assembly of the wet shaving razor attachment 20 to the handle 12. The combination shaving and trimming device 10 can function as a powered wet-shaving device by actuating trimmer 30 while the wet shaving razor attachment 20 is assembled on the handle 12 such that the resulting vibration from moving the at least one trimming blade translates vibration to the razor attachment 20.

In another embodiment (not shown), the wet-shaving razor attachment 20 includes an ejection mechanism for removably attaching the razor cartridge 24 from the connecting member 22. In yet another embodiment, the razor cartridge 24 includes one or more razor blades on a front surface and at least one blade disposed substantially perpendicular to the front surface. The razor cartridge 24 can be of the type disclosed in U.S. Pat. No. 7,669,335 to Vincent Walker and assigned to The Gillette Company.

Figure 9:
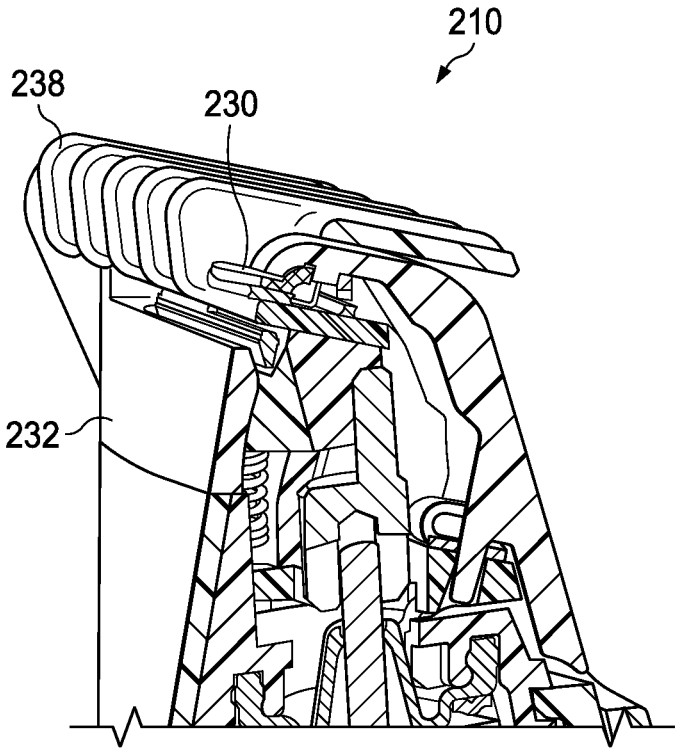
FIG. 9 shows a partial cross-sectional view of a combination wet shaving and trimming device with a trimmer comb attached.

In another embodiment, comb attachments for trimming hair to a desired length may be assembled to the trimming device 210 when the wet shaving razor attachment is completely removed. As shown in FIG. 9, comb attachment 238 can be configured to attach to the trimmer housing 232 using some or all of the same connecting features used for the wet shaving razor attachment.

In the embodiment shown in FIGS. 2*a*-2*d*, the trimming device 10 includes a trimmer housing 32 comprising at least one overhanging edge 34 disposed on the front side 18 of the trimmer 30 that interfaces with the connecting member 22 of the wet shaving razor attachment 20. In an alternate embodiment, the trimmer housing 32 can include two spaced apart overhanging edges 34 disposed on the front side 18 on opposite sides of the trimmer 30 which is to the left and right of the trimmer 30. In another embodiment described more fully below, the trimmer housing 32 can include two spaced apart alignment guides disposed proximate the powered trimmer 30 on opposite sides of the trimmer housing 32 providing mating, releasable attachment with alignment guides disposed on the connecting member 22 of the wet shaving razor attachment 20.

The trimming device 10 includes a spring loaded slider 40 disposed proximate the upper end 14 on the back side 19 of the handle 12 providing a releasable connection for the wet shaving razor attachment 20. The spring loaded slider 40 includes a slot 42 having a forward side 44 and an aft side 46. The forward side 44 of the slot 42 includes an overhanging lip 48 that interfaces with the connecting member 22 of the wet shaving razor attachment 20. The spring loaded slider 40 includes a spring 70 that biases linear movement of the slider 40 in forward and aft directions. In the embodiment shown in FIGS. 2*a* and 2*c*, the spring 70 is located near the forward side 44 of the slot 42. However, in alternate embodiment shown in FIG. 3 fully described below, the spring 170 is located near the aft side 146 of the slot 142.

The wet shaving razor attachment 20 comprises a connecting member 22 having a forward end 50 and an aft end 52; a front face 54 and a back face 56. The connecting member 22 includes an overhanging shoulder 58 disposed on the front face 54 proximate the forward end 50. The overhanging shoulder 58 releasably attaches to the overhanging edge 34 of the trimmer housing 32. In a alternate embodiment described more fully below, the connecting member includes alignment guides disposed on opposite sides of the connecting member that releasably mate with alignment guides disposed on the trimmer housing 32.

Figure 2A:
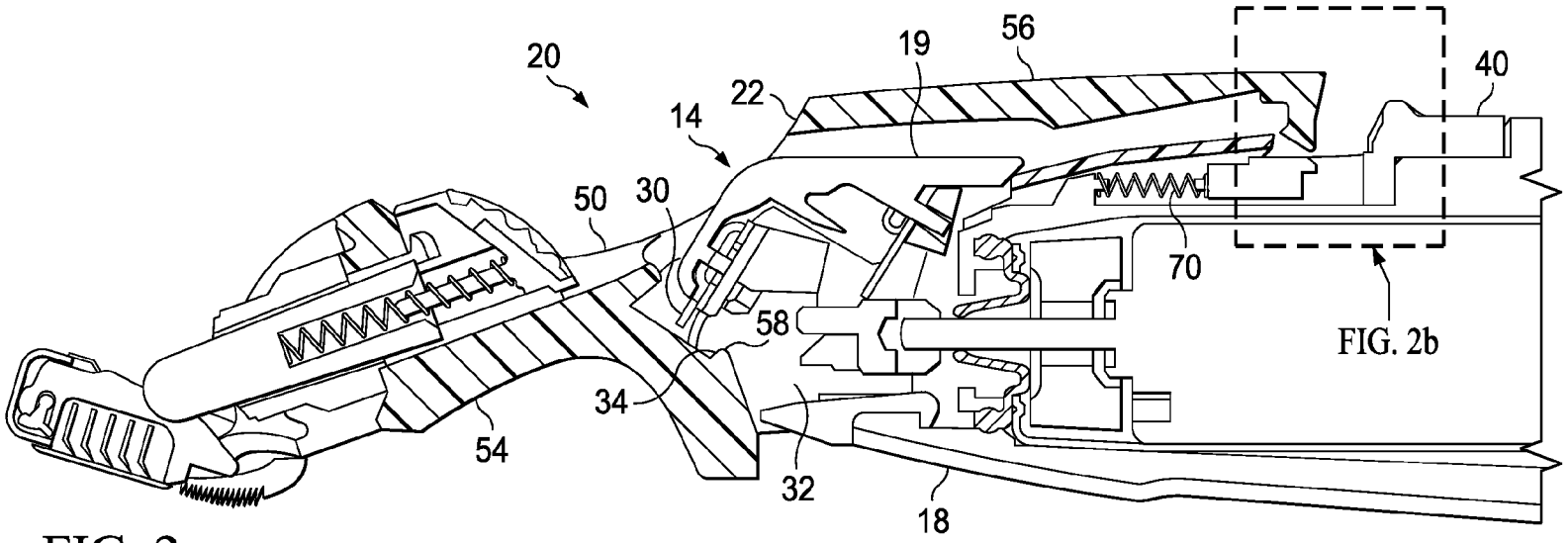
FIGS. 2*a*-2*d* are cross section views of the combination wet shaving and trimming device showing the locking mechanism for the wet shaving razor attachment.
Figure 2B:
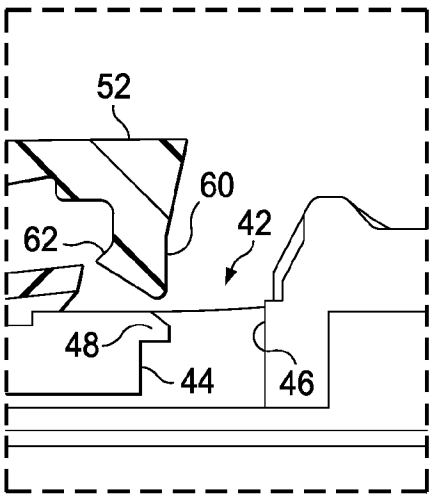
Figure 2C:
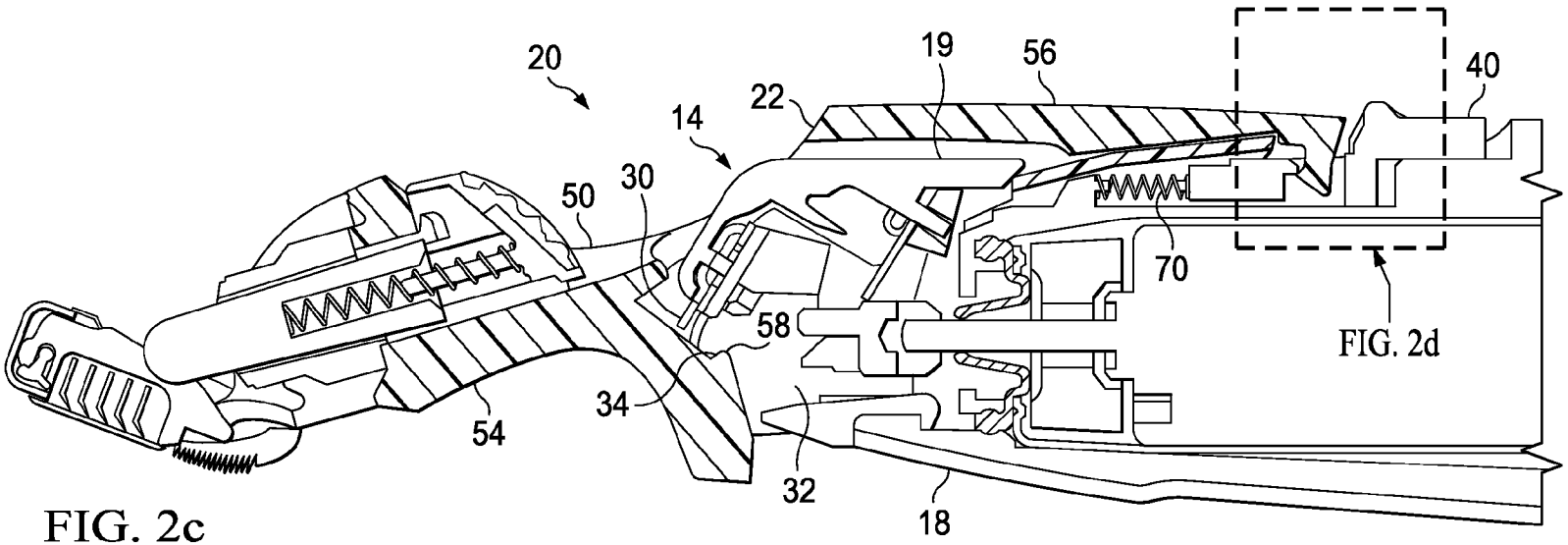
Figure 2D:
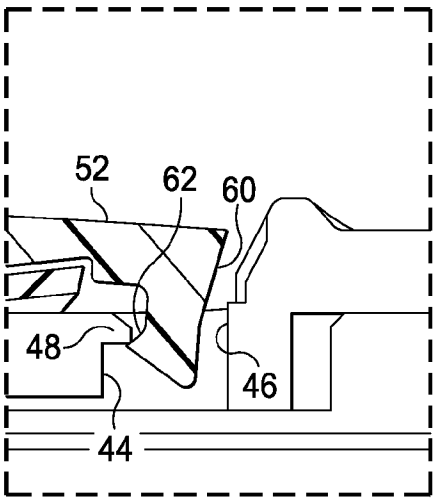

At least one hook 60 is disposed on the front face 54 of the connecting member 22 at the aft end 52. The hook 60 includes a latching surface 62. As shown in FIGS. 2*b* and 2*d*, the hook 60 releasably attaches to the slot 42 in the spring loaded slider 40 such that the latching surface 62 abuts the overhanging lip 48 on the forward side 44 of the slot 42. An audible click is produced while attaching the hook 60 of the connecting member 22 to the overhanging lip 48 on the forward side 44 of the slot 42. In an alternate embodiment not shown, the connecting member can include two or more hooks disposed at the aft end of the connecting member.

In the embodiment shown in FIGS. 2*a*-2*d*, the latching surface 62 is angled so that the spring force produced by the spring 70 attached to the slider 40 pulls the connecting member 22 into a close fitting relationship with the handle 12. The combination of the angled configuration of the latching surface 62 and spring loaded slider 40 also allows the connecting member 22 to disengage under excessive force such as a sudden impact produced as a result of dropping the device 10. Allowing the connecting member 22 to separate from the handle 12 under such force can save the connecting member 22 from breaking in case the device is accidently dropped during use.

Figure 3:
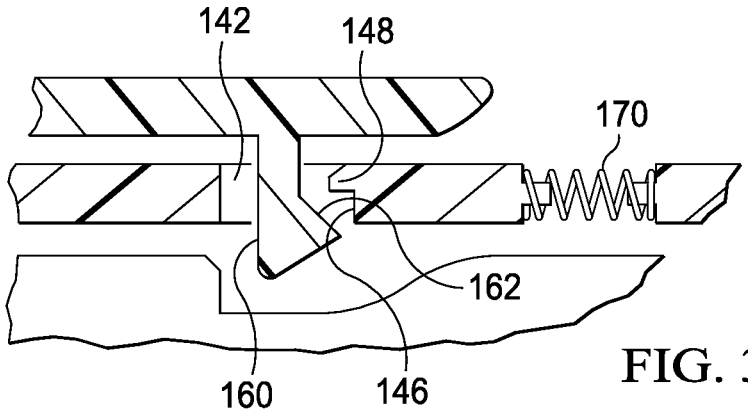
FIG. 3 is a cross section of an alternate embodiment of the locking mechanism shown in FIGS. 2*a*-2*d*.

In the alternate embodiment shown in FIG. 3 where the spring 170 is located near the aft side 146 of the slot 142, the hook 160 and corresponding latching surface 162 are oriented toward the aft side 146 of the slot 142. In this embodiment, the aft side 146 of the slot 142 includes the overhanging lip 148 which interfaces with latching surface 162 on hook 160.

Figure 4A:
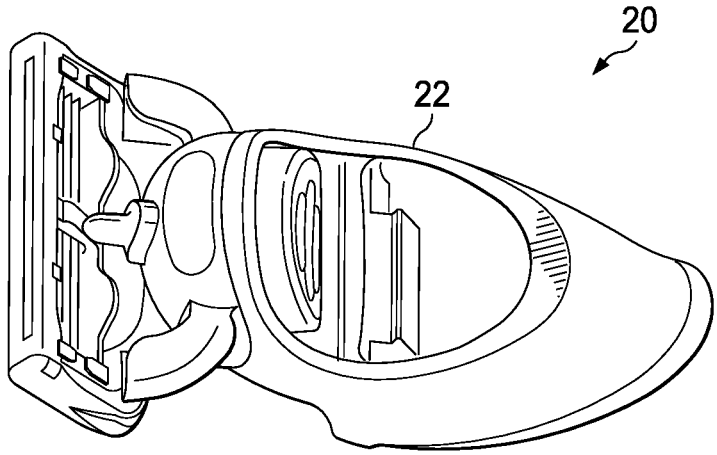
FIGS. 4*a*-4*c* are perspective views of the wet shaving razor attachment.
Figure 4B:
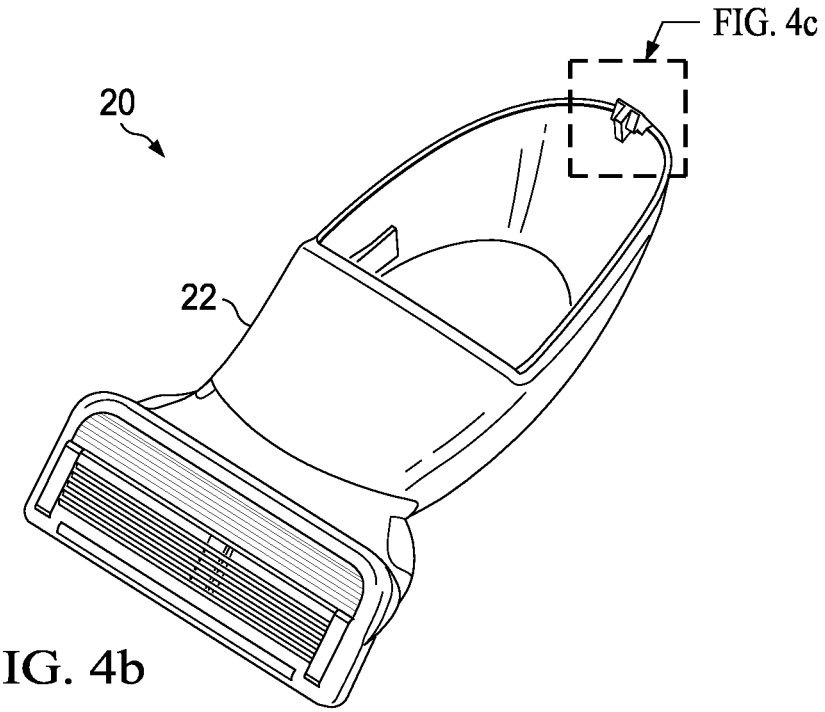
Figure 4C:
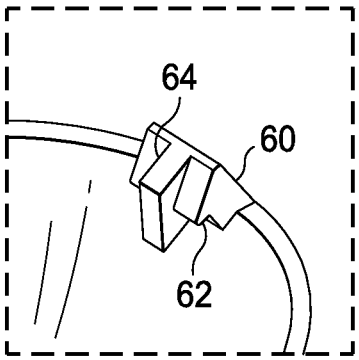
Figure 5:
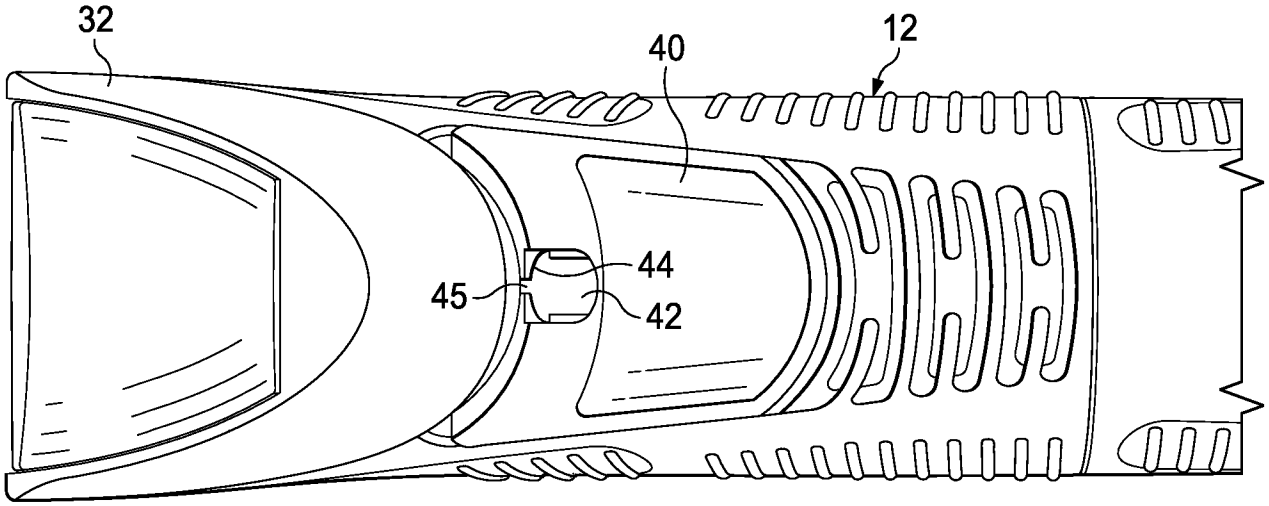
FIG. 5 is a top view of a trimmer embodiment according to the present invention.
Figure 6A:
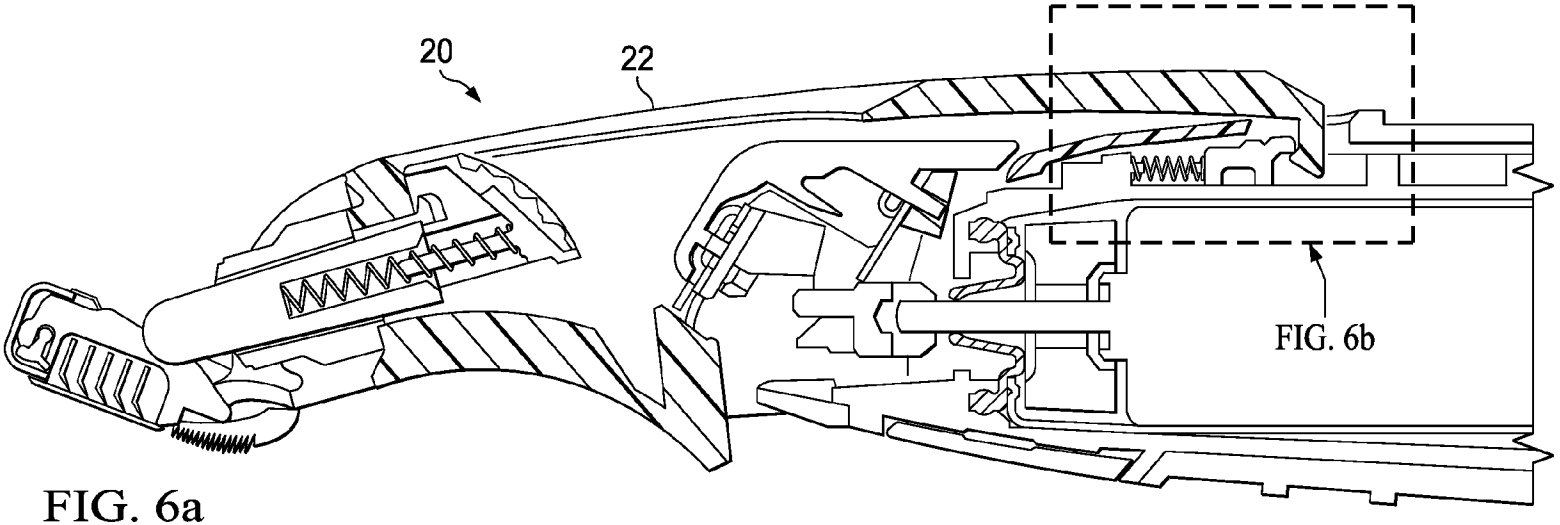
FIGS. 6*a* and 6*b* are cross section views of a locking mechanism for the trimmer embodiment shown in FIG. 5.
Figure 6B:
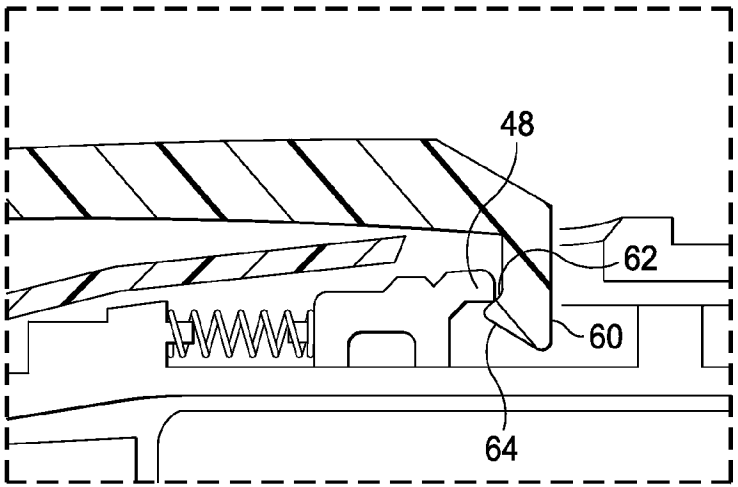

In one embodiment shown in FIGS. 4*a*-4*c*, the hook 60 on the connecting member 22 includes a rib 64 that limits movement of the connecting member 22 during normal use (i.e. shaving, removing a cartridge from the connecting member, etc.). The rib 64 is disposed in the middle of the forward face of the hook 60. For this embodiment, the slot 42 in spring loaded slider 40 shown in FIG. 5 includes a channel 45 in the forward side 44 of the slot 42 to accommodate the rib 64. The channel 45 is oriented perpendicular to the forward side 44 of the slot 42. FIGS. 6*a* and 6*b* show the wet shaving razor attachment 20 including the connecting member 22 and hook 60 with the rib 64 releasably attached to the slot 42 and channel 45 shown in FIG. 5.

In an alternate embodiment shown in FIG. 7*a*-7*d*, the connecting member 222 can be configured to provide the biased releasable connection between the connecting member 222 and the handle 212. For this embodiment, the handle 212 is configured with the slot 242 disposed directly in the back side 219 of the handle 212 proximate the upper end 214 without a spring loaded slider. Similar to the slider configuration previously described, the slot 242 in the handle 212 includes a forward side 244 and an aft side 246. The forward side of the slot includes an overhanging lip 248. The connecting member 222 includes a front face 254 and a back face 256 and a forward end 250 and a resilient flexible aft end 252. An overhanging shoulder 258 is disposed on the front face 254 proximate the forward end 250. The overhanging shoulder 258 releasably attaches to at least one overhanging edge 234 of the trimmer housing 232 on the front side 218 of the handle 212. Preferably, the overhanging shoulder 258 releasably attaches to two overhanging edges 234 of the trimmer housing 232 disposed on opposite sides of the trimmer 230. A hook 260 is disposed on the front face 254 at the resilient flexible aft end 252. The hook 260 includes a forward facing latching surface 262, wherein the hook 260 releasably attaches to the slot 242 in the back side 219 of the handle 212. The latching surface 262 is biased against the overhanging lip 248 on the forward side 244 of the slot 242 by the resilient flexible aft end 252.

Figure 7A:
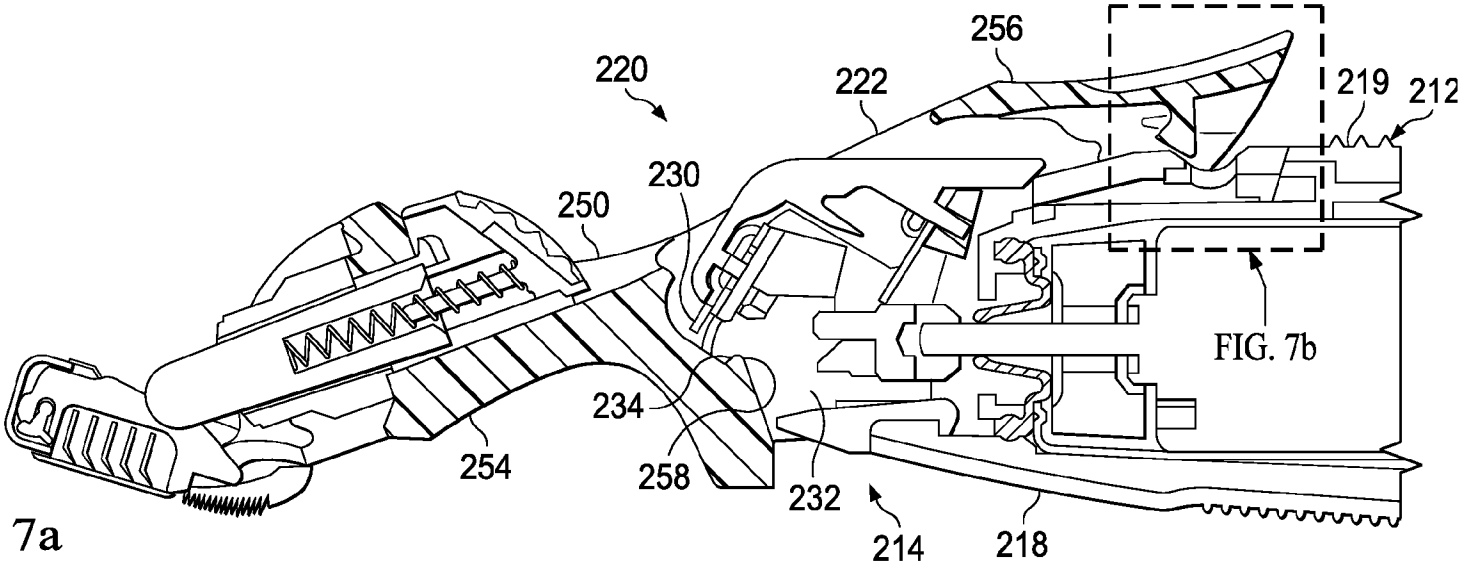
FIGS. 7*a*-7*d* are cross sections of alternate embodiments of the wet shaving razor attachment.
Figure 7B:
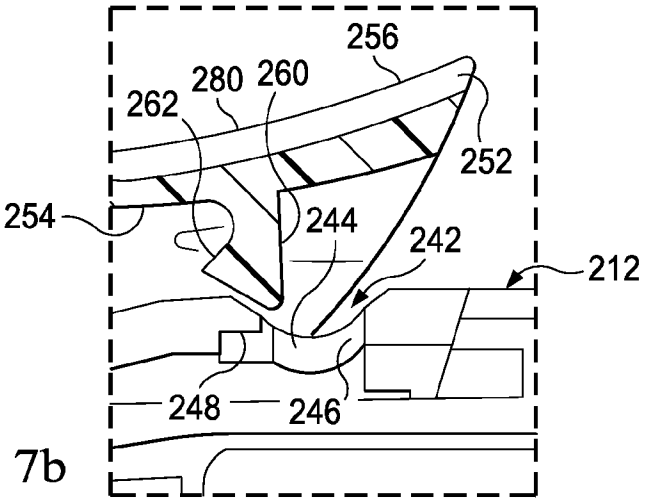
Figure 7C:
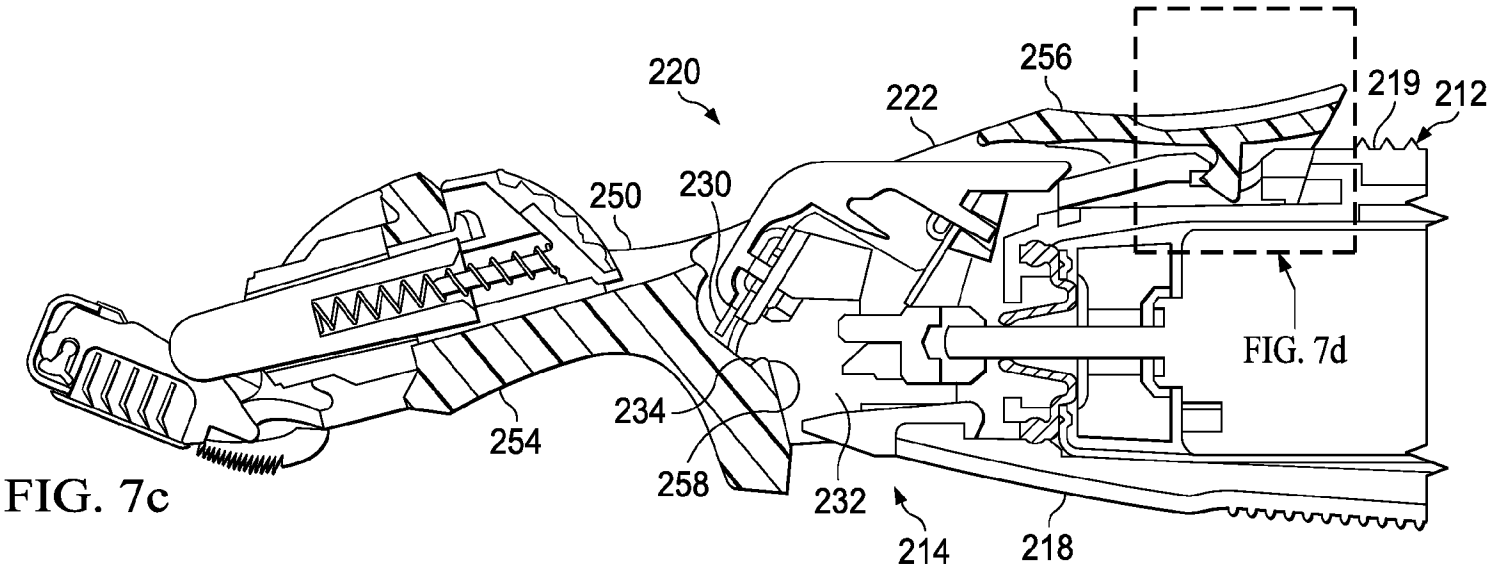
Figure 7D:
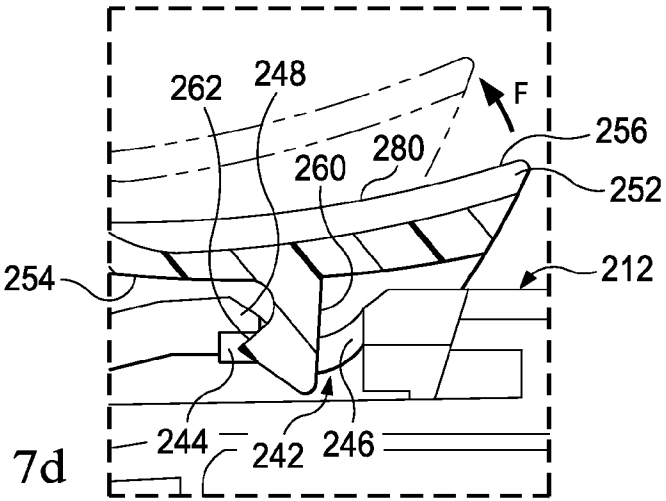

For this embodiment, the resilient aft end 252 of the connecting member 222 can include molded elastic element 280 attached to the back face 256 of the connecting member 222 as shown in FIG. 7*a*-7*d*. The molded elastic element 280 provides resilient flexibility necessary for releasable attachment between the connecting member 222 and the handle 212. As shown in FIG. 7*d*, the connecting member 222 is removed by applying force F to the resilient aft end 252 of the connecting member 222.

Figure 8A:
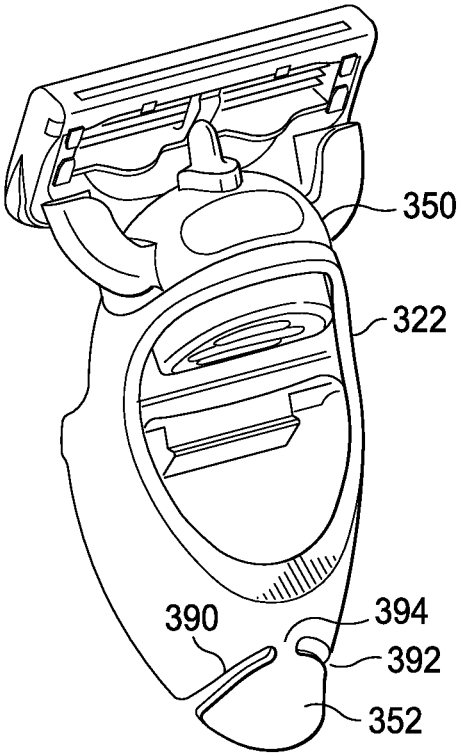
FIGS. 8*a* and 8*b* are perspective views of alternate embodiments of the wet shaving razor attachment.
Figure 8B:
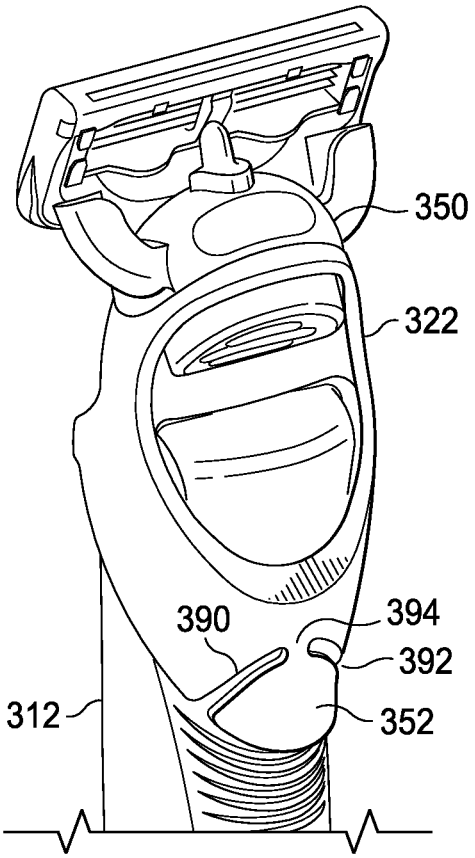

In an alternate embodiment shown in FIGS. 8*a* and 8*b*, the connecting member 322 can be composed of a hard plastic and the resilient aft end 352 can be configured to be resiliently flexible. In the embodiment shown in FIG. 8*a*, the aft end 352 is partially separated from the forward end 350 by discontinuous slots 390, 392 in opposing sides of the connecting member 322 forming an integral strip 394 of hard plastic connecting the aft end 352 to the forward end 350 of the connecting member 322. The integral strip 394 of hard plastic forms a resilient flexible aft end 352 enabling the aft end 352 and corresponding hook (not shown) to deflect during removable attachment of the connecting member 322 to the handle 312 as shown in FIG. 8*b*.

Figures 10A, 10B, 10C:
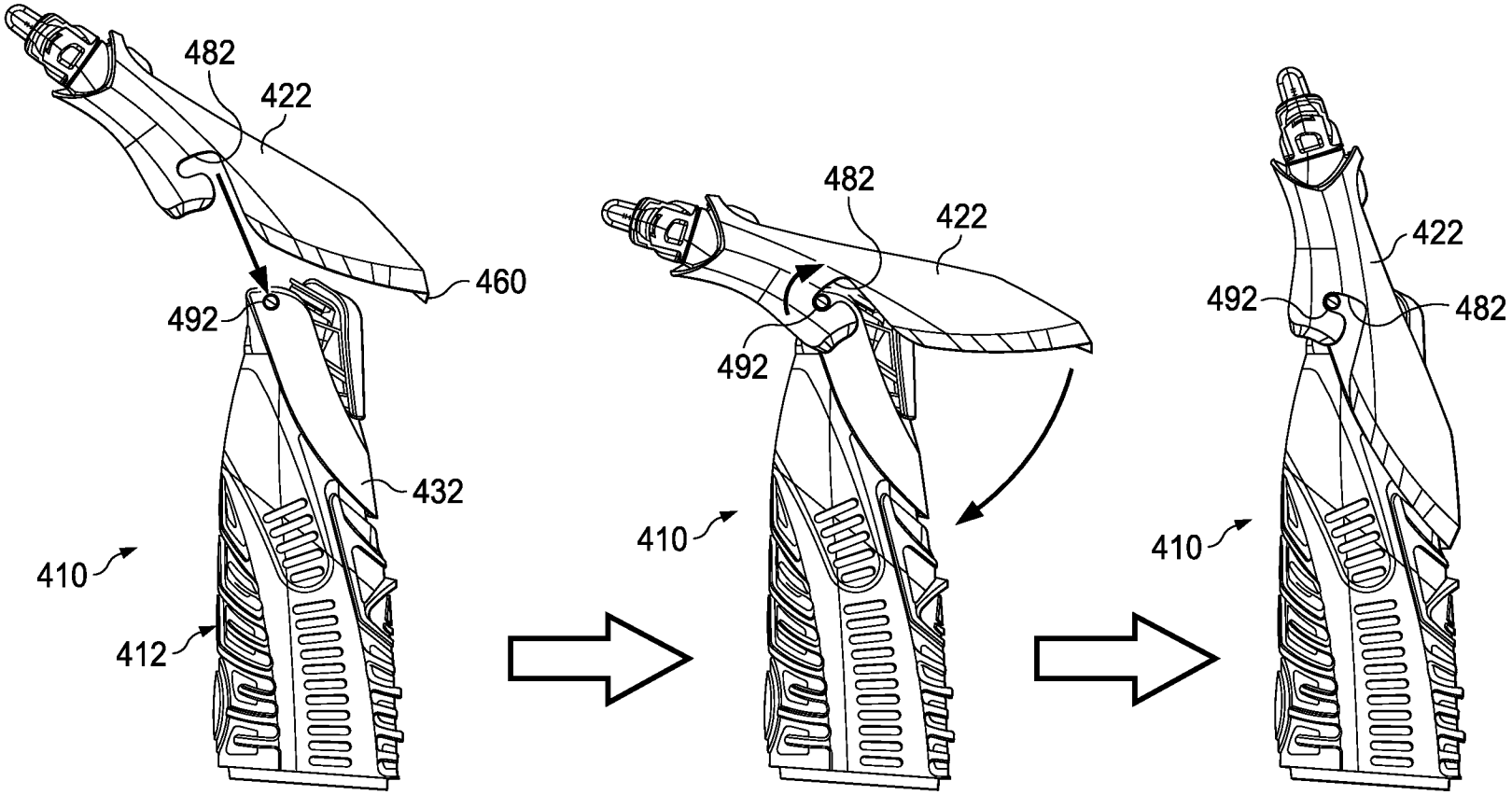
FIGS. 10*a*-10*c* are perspective views of the combination shaving and trimming device illustrating the installation of the wet shaving razor attachment utilizing the alignment guides and alignment members according to the present invention.

In order to ensure correct assembly of the wet shaving razor attachment 20 to the trimmer 10, the combination shaving and trimming device can include features providing one way attachment of the wet shaving razor attachment 20 to the trimmer 10. FIGS. 10*a*-10*c* illustrate the progression of the assembly of the wet shaving razor attachment 422 to the trimming device 410 including alignment guides providing one way attachment. Such features can include alignment guides disposed on both the trimming device 410 and the connecting member 422 of the wet shaving razor attachment.

Figure 11:
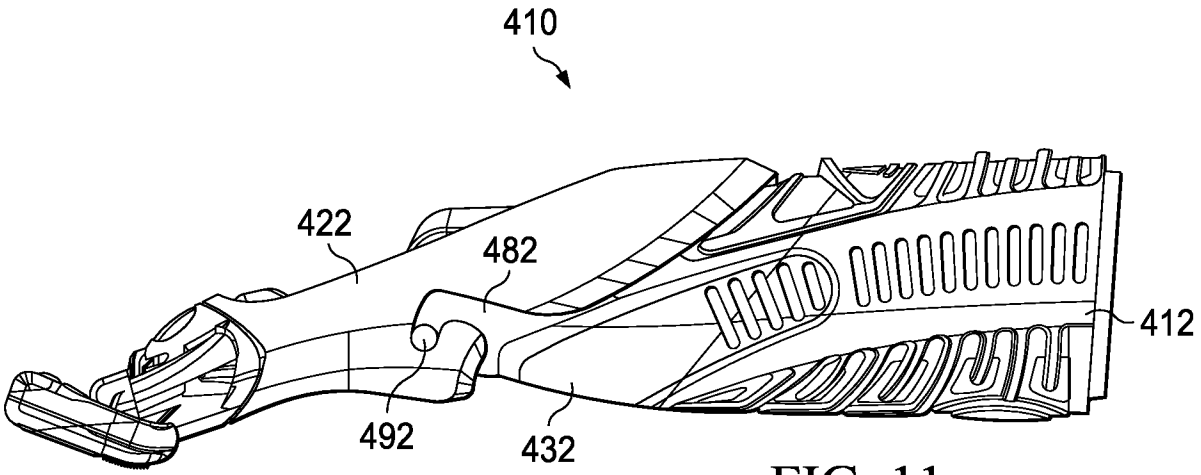
FIG. 11 is a side view of the combination shaving and trimming device including the alignment guides and alignment members according to the present invention.

For the embodiment shown in FIGS. 10*a*-10*c*, the trimmer housing includes alignment members 492 disposed on the trimmer housing 432 proximate the powered trimmer blade on opposite sides of the trimmer housing 432. For this embodiment the connecting member 422 includes alignment grooves 482 disposed on opposite sides of the connecting member 422 proximate the forward end of the connecting member 422. The alignment grooves 482 mate with the alignment members 492. As shown in FIG. 11 the alignment members 492 can include pins extending from the trimmer housing 432 and the alignment grooves 482 can include slots in opposing sides of the connecting member 422. For the embodiment shown in FIGS. 10*a*-10*c* and FIG. 11, the alignment grooves 482 in the connecting member 422 are L-shaped to provide one way attachment of the connecting member 422 to the trimmer housing 432 and promote rotation of the connecting member 422 about the pins 492 in order to bring the hook 460 on the aft end of the connecting member 422 into contact with the slot in the backside of the trimmer handle 412.

Figure 12A:
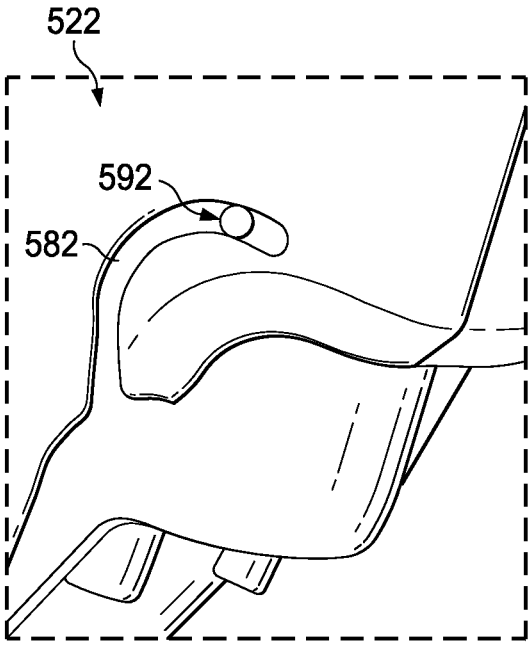
FIG. 12*a* is side view of the connecting member showing the visible portion of a stepped slot and tiered pin at assembly.
Figure 12B:
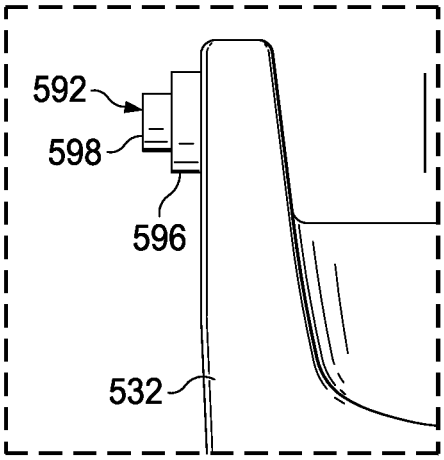
FIG. 12 *b* is a cross sectional view of the tiered pin interfacing with the stepped slot shown in FIG. 12*a*.
FIG. 12*c* is a side view of the inside surface of the connecting member showing the stepped surface of the stepped slot shown in FIG. 12*a*.
Figure 12C:
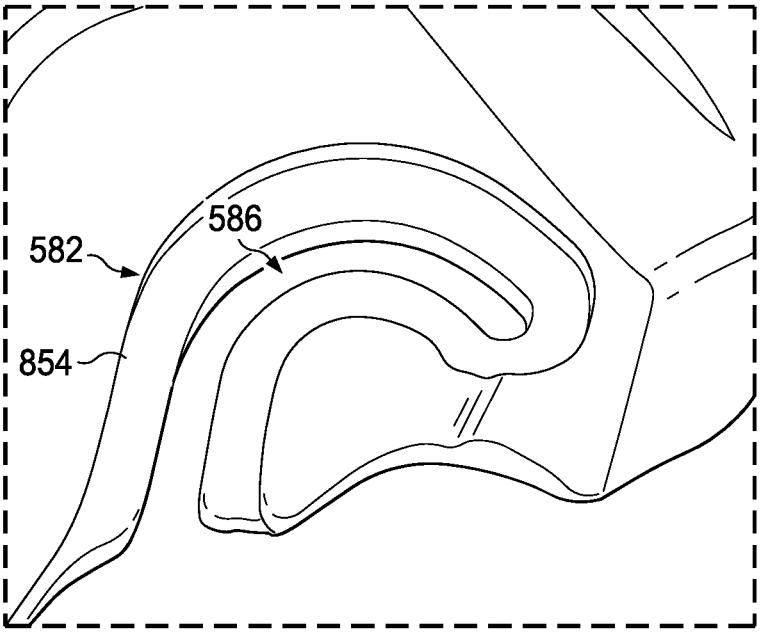

In an alternate embodiment shown in FIG. 12*a*-12*c*, the alignment members include tiered pins and the alignment grooves include stepped grooves in order to minimize the impact of the alignment guides on the aesthetics of the combination shaving and trimming device. The tiered pins 592 include a base 596 having a first diameter joined to the trimmer housing 532 and tip 598 extending away from the trimmer housing 532 having a second diameter wherein the first diameter is larger than the second diameter. For this embodiment, the alignment grooves 582 in the connecting member 522 comprise a compound groove 582 on the inside surface of the connecting member 522 forming a first channel 584 having a first width on the inside surface of the connecting member 522 and a second channel 586 inside of the first channel 584 having a second width that is smaller than the first width. At assembly the first channel 584 receives the base 596 of the tiered pin 592 and the second channel 586 receives the tip 598 of the tiered pin 592. The diameter of the pin 592 at the base 596 is sized to provide good mechanical resistance and a good guiding surface and a step is created in order to reduce the diameter of the tip portion 598 of the pin. As a result, only the second channel portion 586 of the alignment grove 582 on the connecting member 522 and tip portion 598 of the tier shaped pin 592 on the trimmer housing 532 are visible upon assembly. In another embodiment, a translucent material may cover the second channel portion 586 thereby closing the second channel portion such that the tip portion 598 of the tier shaped pin 592 is visible but not exposed at assembly.

Figure 13:
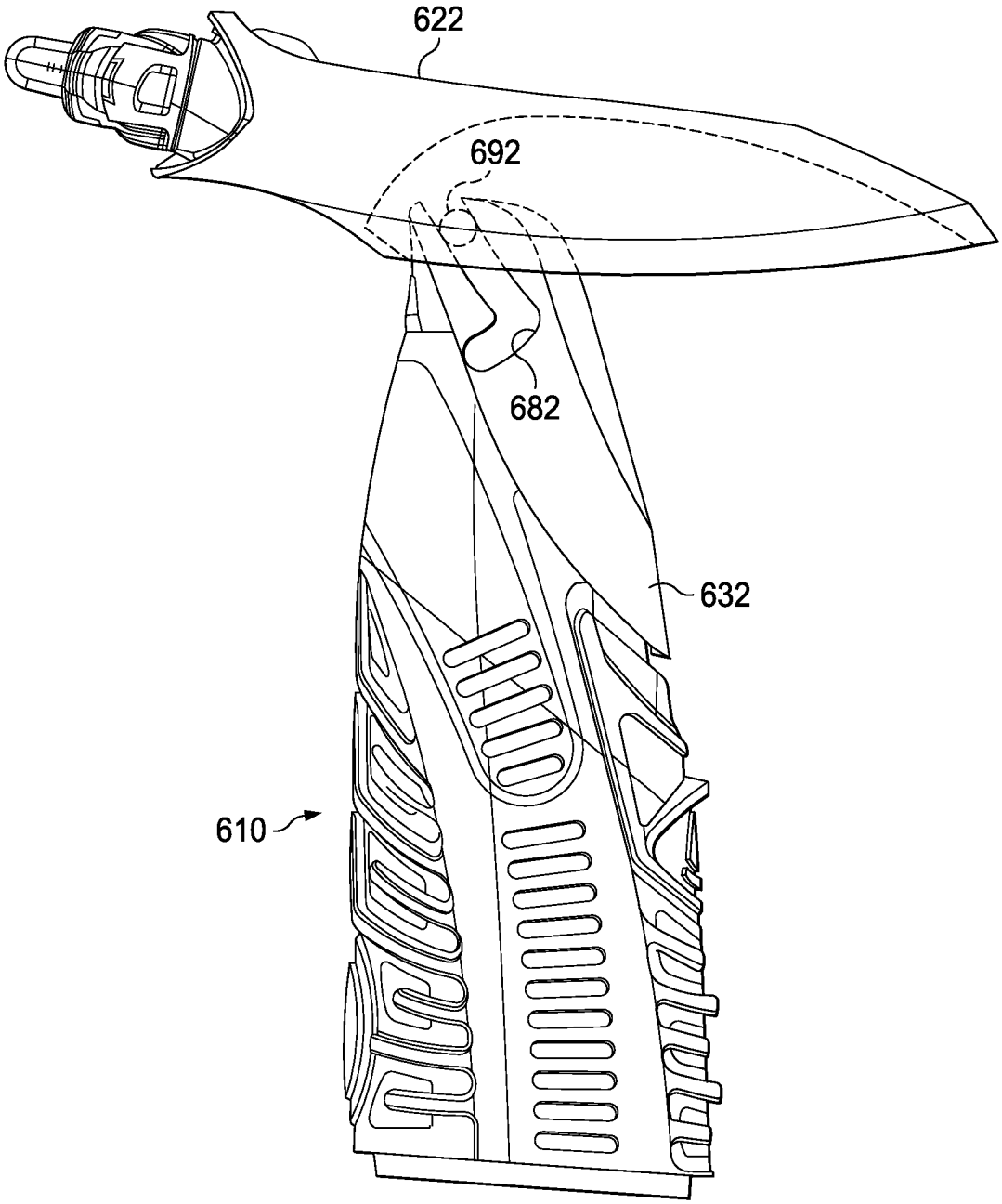
FIG. 13 is side view of a connecting member attaching to a trimmer housing where alignment members are disposed on the inside surface of the connecting member and alignment guides comprising grooves are disposed on the external surface of the trimmer housing.

In another embodiment shown in FIG. 13, the trimming device 610 includes alignment guides on the trimmer housing 632 comprising alignment grooves 682 and the alignment guides on the connecting member 622 comprising alignment members 692. For this embodiment the alignment members 692 include pins disposed on the inside surface of the connecting member 622 on opposing sides of the connecting member 622. The alignment grooves 682 include channels proximate the powered trimmer blade on opposing sides of the trimmer housing 632.

Figures 14A, 14B, 14C:
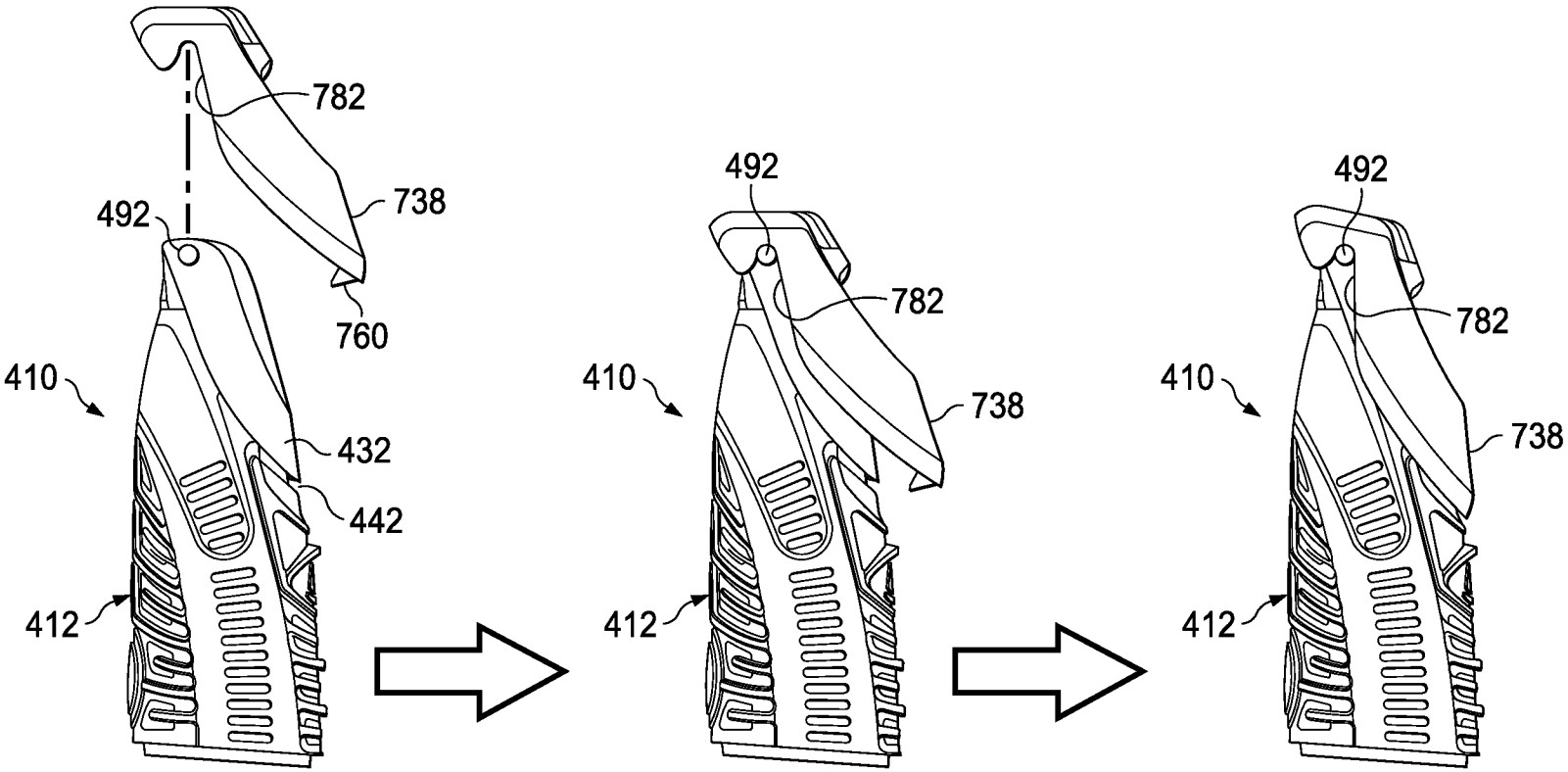
FIGS. 14*a*-14*c* are perspective views of the combination shaving and trimming device illustrating the installation of the wet shaving razor attachment with alignment guides.

The comb attachments previously described and shown in FIG. 9 for trimming hair to a desired length may be assembled to the trimming device 410 using alignment guides and alignment members previously described. As shown in FIGS. 14*a*-14*c*, comb attachment 738 can be configured to attach to the trimmer housing 432 of the trimming device 410 using some or all of the same connecting features used for the wet shaving razor attachment. For this embodiment, the comb attachment 738 includes alignment grooves 782 disposed on opposite sides of the comb attachment 738 proximate the forward end of the comb attachment 738. The alignment grooves 782 mate with the alignment members 492 on the trimmer housing 432. As shown in FIG. 14*a*, the alignment members 492 can include pins extending from the trimmer housing 432 and the alignment grooves 782 can include slots in opposing sides of the comb attachment 738. Similar to the connecting members previously described and shown in FIGS. 10*a*-10*c*, the comb attachment 738 shown in FIGS. 14*a*-14*c* include L-shaped alignment grooves 782 providing one way attachment of the comb attachment 738 to the trimmer housing 432 and promoting rotation of the comb attachment 738 about the pins 492 in order to bring the hook 760 on the aft end of the comb attachment 738 into contact with the slot 442 in the backside of the trimmer handle 412.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combination shaving and trimming device comprising:

a handle having an upper end and a lower end comprising:

a powered trimmer blade disposed adjacent the upper end;

a trimmer housing disposed adjacent the upper end having alignment members disposed proximate the powered trimmer blade on opposite sides of the trimmer housing; and a slot disposed in the handle proximate the upper end, the slot having a forward side and an aft side, the forward side including an overhanging lip; and a wet-shaving razor attachment comprising:

a connecting member having a forward end and an aft end, the connecting member comprising:

alignment grooves disposed on opposite sides of the connecting member proximate the forward end, the alignment grooves releasably attaching to the alignment members on the trimmer housing; and at least one hook disposed at the aft end, the hook includes a latching surface, wherein the hook releasably attaches to the slot in the handle, wherein the latching surface is biased against the overhanging lip on the forward side of the slot;

and a razor cartridge attached to the forward end of the connecting member.

2. The device of claim 1 wherein the latching surface and the hook are angled to pull the connecting member into a close fitting relationship with the handle and to allow the connecting member to disengage under excessive force induced by dropping the device.

3. The device of claim 1 wherein the hook includes a rib that limits movement of the connecting member during normal use.

4. The device of claim 1 wherein the alignment members comprise pins.

5. The device of claim 4 wherein the pins comprise a tiered pin comprising a base having a first diameter and a tip having a second diameter wherein the first diameter is larger than the second diameter.

6. The device of claim 5 wherein the alignment groove comprises a compound groove forming a first channel having a first width and a second channel inside the first channel having a second width that is smaller than the first width, wherein the first channel receives the base of the tiered pin and the second channel receives the tip of the tiered pin.

7. The device of claim 1 wherein the alignment grooves comprise slots or channels.

8. The device of claim 1 wherein the razor cartridge is removably attached to the forward end of the connecting member.

9. The device of claim 8 wherein the razor cartridge is removably attached to the forward end of the connecting member.

10. The device of claim 8 wherein the wet-shaving razor attachment further comprises an ejection mechanism for detaching the razor cartridge from the connecting member.

11. The device of claim 1 wherein the alignment grooves disposed on opposite sides of the connecting member are L-shaped to interface with the alignment members and provide one way attachment of the connecting member to the trimmer housing.

12. A combination shaving and trimming device comprising:

a handle having an upper end and a lower end comprising:

a powered trimmer blade disposed adjacent the upper end;

a trimmer housing disposed adjacent the upper end having alignment members disposed proximate the powered trimmer blade on opposite sides of the trimmer housing; and a spring loaded slider proximate the upper end, the spring loaded slider comprising:

a spring, biasing linear movement of the slider in forward and aft directions; and a slot having a forward side and an aft side, the forward side including an overhanging lip;

and a wet-shaving razor attachment comprising:

a connecting member having a forward end and an aft end, the connecting member comprising:

alignment grooves disposed on opposite sides of the connecting member proximate the forward end, the alignment grooves releasably attaching to the alignment members on the trimmer housing; and a hook disposed at the aft end, the hook includes a latching surface, wherein the hook releasably attaches to the slot in the spring loaded slider, wherein the latching surface is biased against the overhanging lip on the forward side of the slot;

and a razor cartridge attached to the forward end of the connecting member.

13. The device of claim 12 wherein the latching surface and the hook are angled to pull the connecting member into a close fitting relationship with the handle and to allow the connecting member to disengage under excessive force induced by dropping the device.

14. The device of claim 12 wherein the hook includes a rib that limits movement of the connecting member during normal use.

15. The device of claim 12 wherein the alignment grooves disposed on opposite sides of the connecting member are L-shaped to interface with the alignment members and provide one way attachment of the connecting member to the trimmer housing.

16. The device of claim 12 wherein the force produced by the spring loaded slider on the hook and the latching surface of the connecting member produces an audible click during attachment.

* * * * *